US005181868A

United States Patent [19]

Gabriel

[11] Patent Number: 5,181,868

[45] Date of Patent: Jan. 26, 1993

[54] JET PROPULSION DEVICE FOR WATERCRAFT, AIRCRAFT, AND CIRCULATING PUMPS

[76] Inventor: Reinhard Gabriel, Illertalstr. 42 D-8963, Waltenhofen, Fed. Rep. of Germany

[21] Appl. No.: 600,411

[22] Filed: Oct. 19, 1990

[51] Int. Cl.[5] ..... B63H 11/00

[52] U.S. Cl. ..... 440/38; 440/67; 416/177

[58] Field of Search ..... 440/5, 6, 48, 38, 47, 440/67, 68; 416/176, 177; 415/71, 72

[56] References Cited

U.S. PATENT DOCUMENTS

| | | | |
|---|---|---|---|
| 1,805,597 | 5/1931 | Pratt | 440/5 X |
| 2,449,531 | 9/1948 | Lee, Jr. | 416/177 |
| 2,656,809 | 10/1953 | Frasure | 440/38 X |
| 2,993,463 | 7/1961 | McKinney | 415/72 X |
| 2,997,015 | 8/1961 | Richter | 440/38 X |
| 3,011,561 | 12/1961 | Wagener | 440/48 X |
| 3,598,080 | 8/1971 | Shields | 440/38 |
| 3,804,553 | 4/1974 | Hickey, Jr. | 440/38 X |
| 3,914,629 | 10/1975 | Gardiner | 440/6 X |
| 3,977,353 | 8/1976 | Toyama | 440/48 X |

FOREIGN PATENT DOCUMENTS

| | | | |
|---|---|---|---|
| 718857 | 11/1954 | United Kingdom | 440/48 |

*Primary Examiner*—Sherman Basinger
*Attorney, Agent, or Firm*—Horst M. Kasper

[57] ABSTRACT

A jet propulsion drive element is disclosed for the increasing of the power yield of jet engines, in particular for watercraft, employing a rotary-driven jet propulsion pipe (11). A thrust propulsion element is disposed at the inner jacket of the jet propulsion pipe (11), covers an outer annular face (A), and is formed as a screw (17). The outer edge of the screw (17) is connected to the inner jacket of the jet propulsion pipe (11). The edge screw (17) is furnished with a through borehole, such that a part of the fluid entering into the jet propulsion pipe (11) is not directly accelerated by the edge screw (17). In addition, drive elements such as a screw propeller (18) can be furnished at the outer jacket of the jet propulsion pipe (11). The invention structure can be employed also for circulating pumps in addition to applications in aircrafts.

5 Claims, 7 Drawing Sheets

JET PROPULSION DEVICE FOR WATERCRAFT, AIRCRAFT, AND CIRCULATING PUMPS

BACKGROUND OF THE INVENTION

1. Field of the Invention

The present invention relates to a jet propulsion device for watercraft and aircraft, as well as to circulating pumps. The fluid, flowing into a jet propulsion pipe, is accelerated by a rotor, formed as a screw, in a direction opposite to the intended thrust direction. The outer edge of the screw is fixedly connected to the inner jacket of the jet propulsion pipe, such that the screw and the jet propulsion pipe are rotating jointly. The jet propulsion pipe is driven at its outer jacket and is supported in an enveloping pipe or in an enveloping pipe casing or the like.

2. Brief Description of the Background of the Invention Including Prior Art

Such a jet propulsion device is known from the German Utility Patent 1,997,210. A propulsion element, developed as a rotor and disposed in the interior of the jet propulsion pipe, is formed of a single-piece full, solid screw, covering the clear inner space of the jet propulsion pipe. This full, solid screw protrudes at the two front faces of the jet propulsion pipe and projects in propulsion direction into a fixed-position input port and, on the other side, also into a fixed-position discharge port, furnished with paddles and exhibiting an opposite course direction. The jet propulsion pipe is driven by a gear ring, disposed in its center. Since in case of such a screw, there is generated in the neighborhood of the axis an outwardly directed force and on the outer side an inwardly directed force based on the rotation action on the water flowing through, the complete water volume is put into a spinning motion, which causes vortex losses on the discharge side. A following stream deflector can compensate these losses only in part over a limited range of rotation speed. The paddles protruding into the inlet port generate a strong vortex formation. The hydraulic flow-passage cross-section is in addition narrowed based on the strong vortex formation such that only a part volume of the advancing fluid medium is captured and that the power yield thus resulting from the product "mass" times "acceleration" is correspondingly low.

A propeller is known from the German Patent DE-PS 860,154, where the wings or paddles are penetrated and interrupted by a carrying-wing-like nozzle ring. In the latter case, the inner wing parts are to assume a different pitch. It is to be achieved based on the carrying-wing-like structure of the nozzle ring that a strongly converging water stream flowing to the propeller generates an underpressure on the inner face of the propeller and an overpressure on the outer face of the propeller, in the sense of an additional thrust generation. As taught in the two embodiments, of course, the nozzle has to have approximately the length of the projection of the wing width.

A jet pipe is already disclosed in the German Patent Application Laid Open DE-OS 3,343,605 relative to one embodiment of the invention. The intake is structured convergingly and is narrowed by a displacement body to an annular space.

In view of a further embodiment of the invention, the German Patent Application Laid Open DE-OS 3,718,954 teaches already a propeller structure where the outer ring of a propeller is formed as a rotor. A stator surrounding the outer ring of the propeller and cooperating with the propeller is coordinated to the rotor in the casing.

Further, the book in the German language by Richard Geissler, "Der Schraubenpropeller" (The Screw Propeller"), Dissertation, Julius Spring, Berlin, 1918, page 18, mentions a screw propeller. In this case, the wings of the screw propeller are comprised of bands. The bands, exhibiting a half-step winding and wound in themselves, are supported opposite to each other with their ends by way of webs of a drive axis attached in a plane at hubs of a drive shaft. The bands are supported with their center part at a further hub. The fluid, flowing in this case in a direction parallel to the drive axis, is whirled and swirled in an energy-consuming way by the spinning webs such that the power yield becomes very small.

SUMMARY OF THE INVENTION

1. Field of the Invention

It is an object of the invention to provide a jet propulsion device avoiding vortex losses and capturing as far as possible the complete advancing fluid volume in the sense of an increase of the power efficiency.

It is another object of the present invention to provide a jet propulsion device, which is constructed such that, in general, a stream deflector is not necessary.

These and other objects and advantages of the present invention will become evident from the description which follows.

2. Brief Description of the Invention

The present invention provides for a jet propulsion unit for propulsion of watercraft and aircraft. A jet propulsion pipe has an inner jacket and an outer jacket. An enveloping pipe casing supports the jet propulsion pipe. A rotor is formed by at least one screw. Each screw exhibits an outer edge and a through borehole. A fluid, flowing into the jet propulsion pipe, is accelerated by the screw in a direction opposite to the intended thrust direction. A solid connection of the outer edge of the screw to the inner jacket of the jet propulsion pipe results in a joint rotation of said screw with said jet propulsion pipe. Said jet propulsion pipe is driven at its outer jacket. An edge screw is formed by the screw with the through borehole. Part of the fluid entering into the jet propulsion pipe is not directly accelerated by said edge screw.

The jet propulsion pipe is supported in an enveloping pipe. At least one screw propeller can be disposed at the outer jacket of the jet propulsion pipe and can form an additional drive element. The jet propulsion pipe can be converging in a direction from the intake port to the discharge port or can be converging over partial sections between the intake port and the discharge port.

Preferably, the discharge port and possibly also the intake port of the jet propulsion pipe is free of thrust propulsion elements formed by the edge screw. The discharge port of the jet propulsion pipe can be formed as a thrust nozzle.

The wall thickness of the screw can increase in the direction of the discharge port. The shape, the dimension, and the pitch of the screw can be different in the sense of an increase in flow velocity.

Bearings can be provided for rotatably supporting the pipe casing enveloping the jet propulsion pipe. Openings can be disposed at the enveloping pipe casing in the region of the enveloping pipe casing. Said openings can allow an inflow of water. The enveloping pipe casing can be attached to a stand or to an extension arm casing. The enveloping pipe casing can form a single piece with the extension arm casing.

The jet propulsion pipe can be formed as a drive member between the bearings. The drive member can be a crown gear, an armature, or can be formed by paddles. The drive member can be coordinated to a corresponding drive element. Said drive element can be incorporated into the enveloping pipe casing and the extension arm casing, respectively. The drive element can be a gear belt, a drive pinion, a magnet winding, or a turbine including nozzles with feed conduit and return conduit.

The jet propulsion unit as described above can be employed as a circulating pump. In this case, saddle seats can be provided for the jet propulsion pipe. Flange connections can be disposed in the saddle seats on two sides of the enveloping pipe casing. An armature can be disposed at the circumference of the jet propulsion pipe. Said armature can be surrounded by a slot of a magnet winding disposed in the enveloping casing. The jet propulsion pipe can be converging in a direction from the intake port to the discharge port and over partial sections between the intake port and the discharge port. Preferably, the discharge port and possibly also the intake port of the jet propulsion pipe is free of thrust propulsion elements formed by the edge screw. The discharge port of the jet propulsion pipe can be formed as a thrust nozzle. The wall thickness of the screw can increase in the direction of the discharge port. The shape, the dimension, and the pitch of the screw can be different in the sense of an increase in flow velocity. Bearings can be provided for rotatably supporting the pipe casing enveloping the jet propulsion pipe. Openings can be disposed at the enveloping pipe casing in the region of the enveloping pipe casing, to allow an inflow of water.

Apart from the increase of the total thrust and the additional propulsion by the propulsion elements at the outer jacket of the jet propulsion pipe, the present invention furnishes a series of additional advantages. Additionally, there results a smaller energy use based on a larger power yield. As compared to conventional structures, the invention can operate with drive elements having smaller dimensions and lesser weight, while providing the same power. It operates with less noise based on a substantial avoidance of vortexes. The invention device exhibits a longer lifetime based on the avoidance of cavitation, and it is associated with higher operating safety and a simpler servicing.

Based on the subject-matter of the invention, the fluid volume, captured per time unit, can be increased substantially, which furnishes new structural possibilities for airscrews or propellers as well.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The invention illustrates exemplified embodiments of jet propulsion devices for boats and a circulating pumps. The boat propulsion devices are adaptable to use with aircraft.

In the accompanying drawing, in which are shown several of the various possible embodiments of the present invention.

DESCRIPTION OF INVENTION AND PREFERRED EMBODIMENT

The fluid, present in the jet propulsion pipe 11, is set in a rotary motion by the edge screws 17 and impacts with the further suctioned fluid onto the fluid present in the free central passage and accelerates also this fluid in the central passage in a passage direction. A strong propulsion force, acting over nearly the length of the jet propulsion pipe 11, is generated by furnishing of a part of the kinetic energy from the paddles to the central flow. The fluid, present at the forward front face, is continuously suctioned without vortex formation. In principle, the central flow compensates the torque exerted on the overall structure such that, aside from the vortex-free inflow and the avoidance of a vortex formation at the outflow, there results a jet propulsion force not reached previously.

In general, a disposition of a stream deflector at the output end of the jet propulsion pipe 11 is, in addition, eliminated in an advantageous manner.

Figure 1:
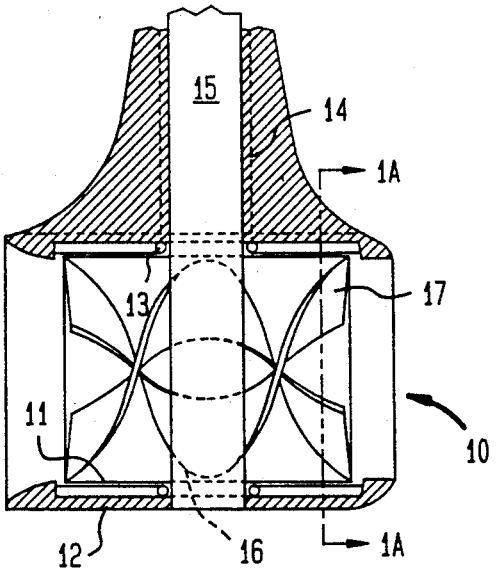
FIG. 1 is an in part sectional view of a jet propulsion pipe with an edge screw.
Figure 1A:
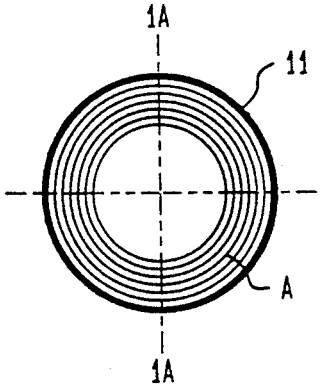
FIG. 1*a* is cross-sectional view of a section of FIG. 1 along section line 1A—1A.
Figure 2:
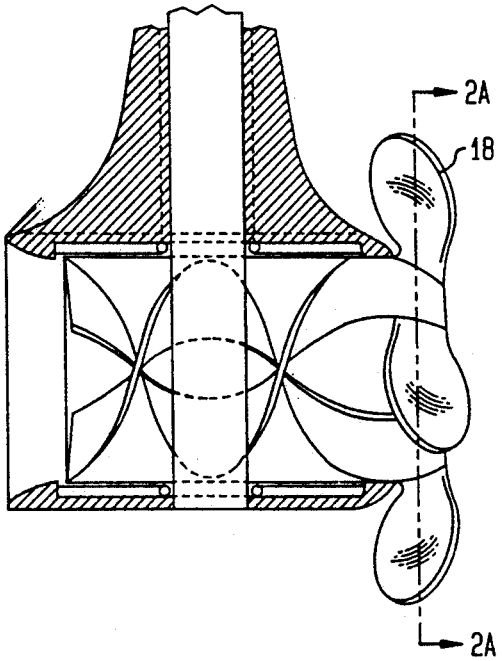
FIG. 2 is an in part sectional view of a jet propulsion pipe with an edge screw and a screw propeller disposed at the outer jacket.
Figure 2A:
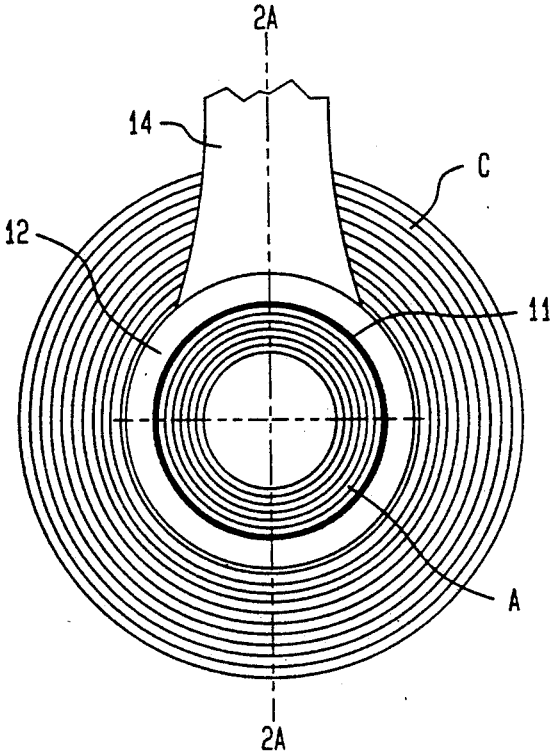
FIG. 2*a* is a cross-sectional view of the embodiment of FIG. 2, along section line 2A—2A.
Figure 3:
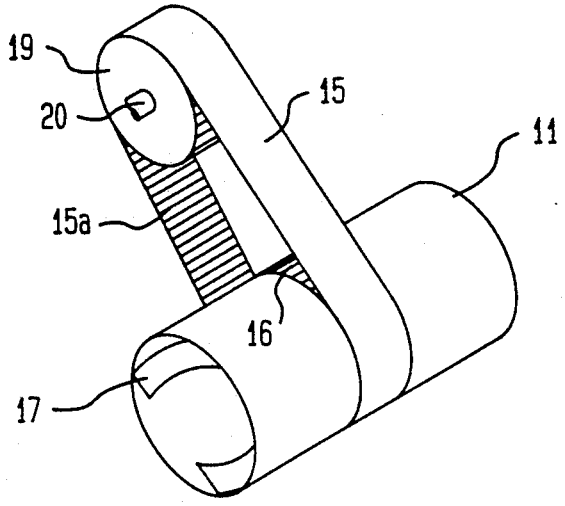
FIG. 3 is a perspective view of a first embodiment of a drive for the jet propulsion pipe.

The jet propulsion pipes 11 of a jet propulsion device 10 according to the invention are illustrated in FIGS. 1 and 2, in each case disposed in an enveloping pipe casing 12, rotatably supported at ring bearings 13. The enveloping pipe casing 12 is formed as a single piece with extension arms 14. As shown in FIG. 3, the jet propulsion pipes 11 are driven by gear belts 15, where the teeth 15a of the gear belts 15 are engaging in a crown gear 16 disposed at the outer jacket of the jet propulsion pipe 11. Two edge screws 17 serve as drive element and are attached with their outer edge to the inner jacket of the jet propulsion pipe 11. As illustrated by the sectional view 1A—1A of FIG. 1*a*, the edge screw 17 covers only an outer field A of the inner space of the jet propulsion pipe. The same disposition as in FIG. 1 is illustrated in FIG. 2. However, in this case, the jet propulsion pipe 11 protrudes on the right-hand side at the enveloping pipe casing 12 and carries a screw propeller 18 at its outer jacket. This screw propeller 18 covers, in addition to a field A, a field C as illustrated in the sectional view 2A—2A in FIG. 2*a*.

Figure 4:
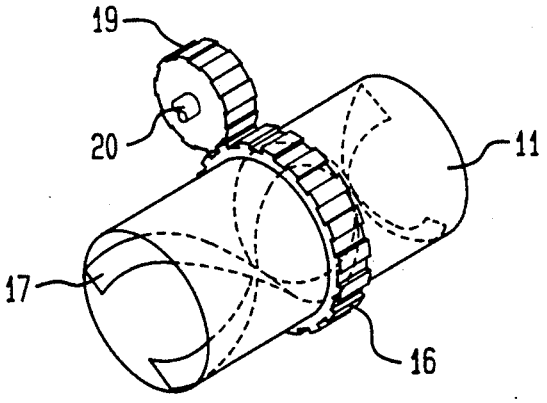
FIG. 4 is a perspective view of a second embodiment of a drive for the jet propulsion pipe.
Figure 5:
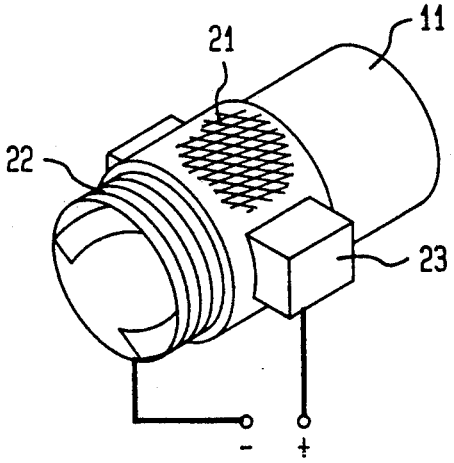
FIG. 5 is a perspective view of a third embodiment of a drive for the jet propulsion pipe.
Figure 6:
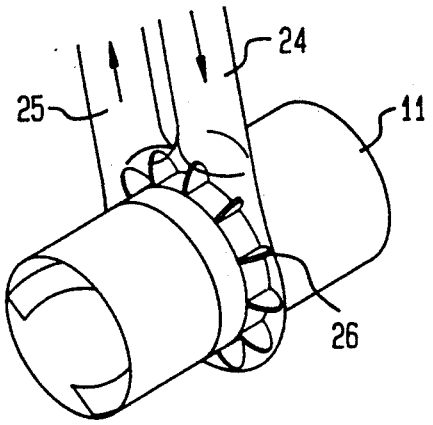
FIG. 6 is a perspective view of a fourth embodiment of a drive for the jet propulsion pipe.
Figure 8:
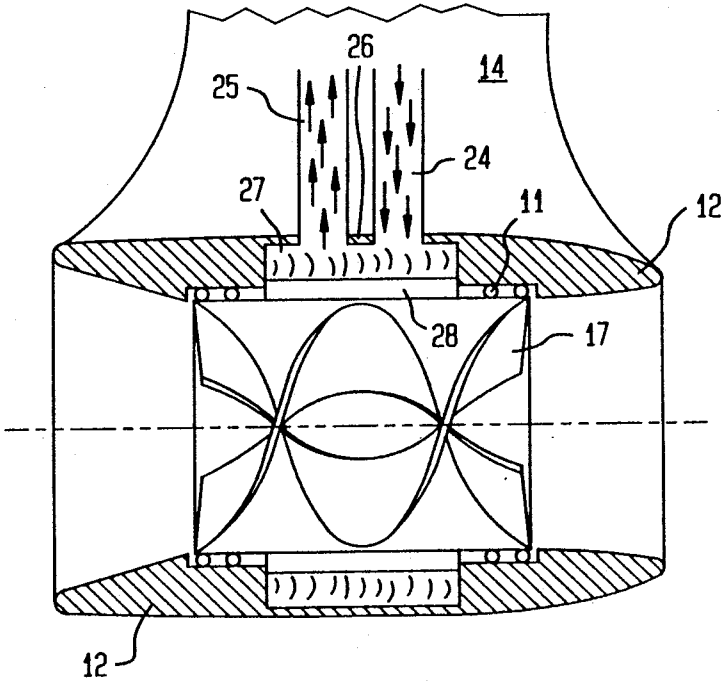
FIG. 8 is a front elevational view of a second embodiment of a support of the jet propulsion pipe in an enveloping casing.

A drive pinion 19 of a motor, indicated by its drive shaft 20, is visible in FIG. 3 in addition to the previously described drive of the jet propulsion pipe 11. As illustrated in FIG. 4, the pinion 19 engages directly with the crown gear 16 of the jet propulsion pipe 11. The jet propulsion pipe 11 is formed as a rotor of an electromotor according to FIG. 5 and carries an armature winding 21. The armature winding 21 is supplied with current via a collector 22. A magnet winding 23 is indicated on the outside. A pressure-means drive with a feed line 24 and a return line 25 and a turbine 26 is schematically indicated in FIG. 6. The latter two recited drive modes are illustrated in more detail in FIGS. 7 and 8 and illustrate in particular the enveloping pipe casings 12 in more detail. According to FIG. 7, the magnet winding 23 is disposed in a recessed chamber or opening 12*a* in the enveloping pipe casing 12. According to FIG. 8, the pressure means acts on paddles 28 at the jet propulsion pipe 11 via the nozzles 27 guiding the pressure means.

Figure 9:
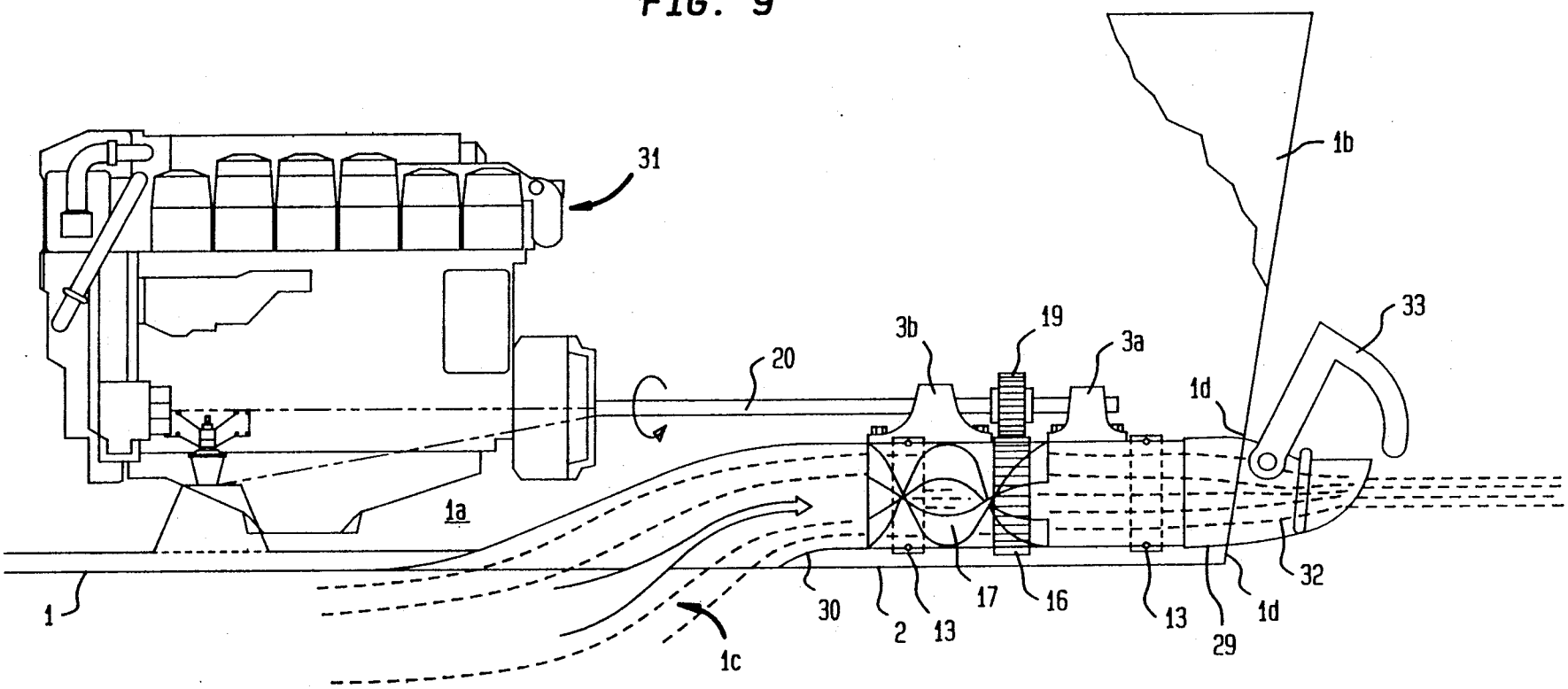
FIG. 9 is a perspective and in part sectional view of a jet propulsion unit incorporated in a boat.
Figure 10:
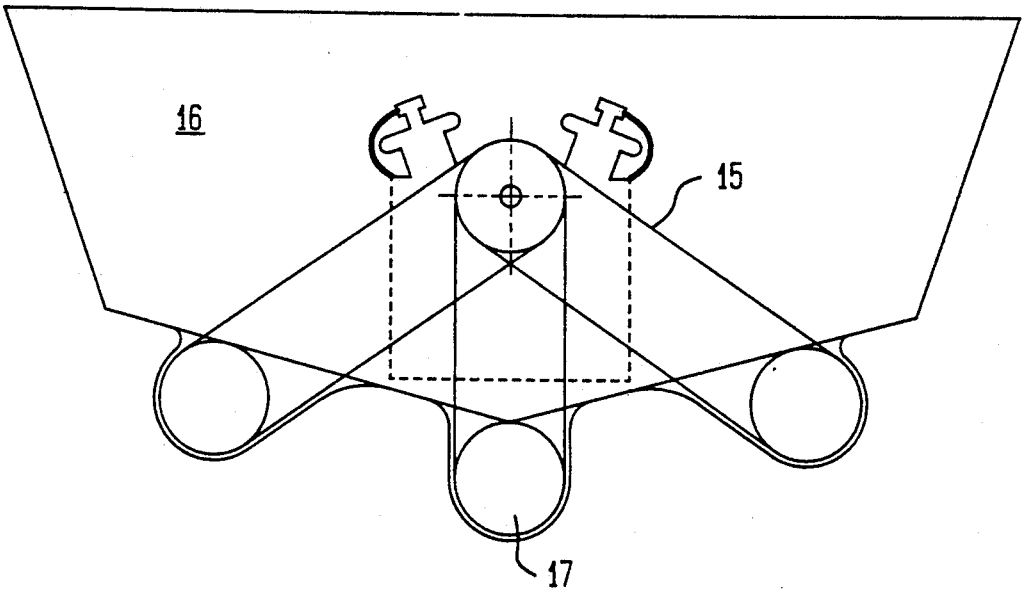
FIG. 10 is a schematic view of a stern, with the jet propulsion pipes disposed below the floor of a boat.
Figure 11:
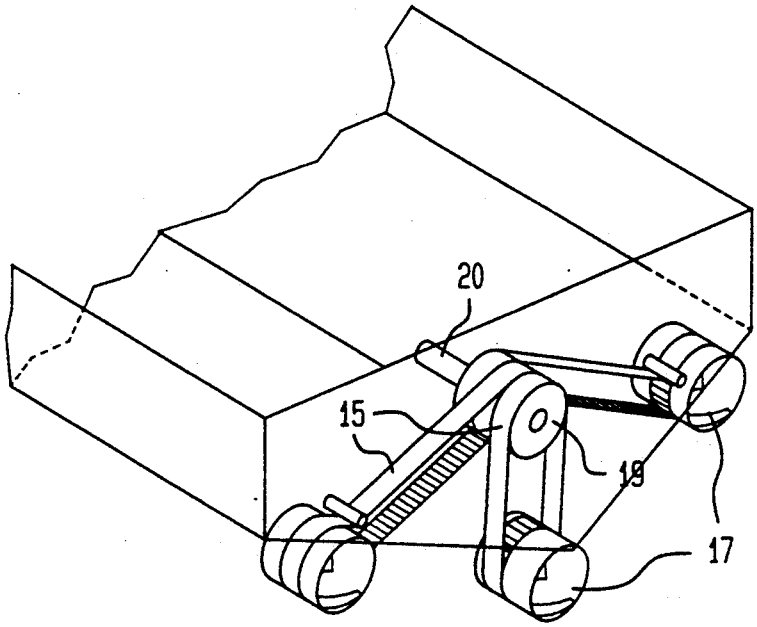
FIG. 11 is a schematic perspective view of a central drive of the jet propulsion pipes according to FIG. 10.

The structure of an invention jet propulsion device 10 is illustrated in connection with a boat in the construction according to FIG. 9. A discharge pipe 29, protruding at the stern 1*b* in rear direction, is supported by a stand 2, disposed on the floor in the bottom bilge space 1*a* of the boat 1, by means of a console 3*a* surrounding the discharge pipe 29. At the second end of the stand 2, a further pipe 30 is supported with its end in a console 3*b* and is connected to a water feed opening 1*c* disposed in the bottom bilge space 1*a*. The jet propulsion pipe 11, supported rotatably in two ring bearings 13 connected with the stand 2, protrudes with its two ends into the pipes 29 and 30 and is fitted into these pipes 29 and 30 with sliding seals, not illustrated here. As can be recognized, the pipe 29 joins into a thrust nozzle 32. For the reversing of the propulsion direction, a deflection sheet-metal piece 33 is to be pivoted in front of the opening of the thrust nozzle 32. The drive shaft 20 of a motor 31 is supported at the top at the consoles 3*a* and 3*b*. The drive pinion 19 of the drive shaft 20 engages at the crown gear 16 of a jet propulsion pipe 11. It is clear that instead of the drive pinion 19, there could be employed a larger drive spur gear, where several jet propulsion pipes 11 could be driven by this larger drive spur gear. The jet propulsion pipes 11 can be disposed around the drive spur gear along a partial circle. This is schematically indicated in FIGS. 10 and 11 by the gear belt 15.

Figure 12:
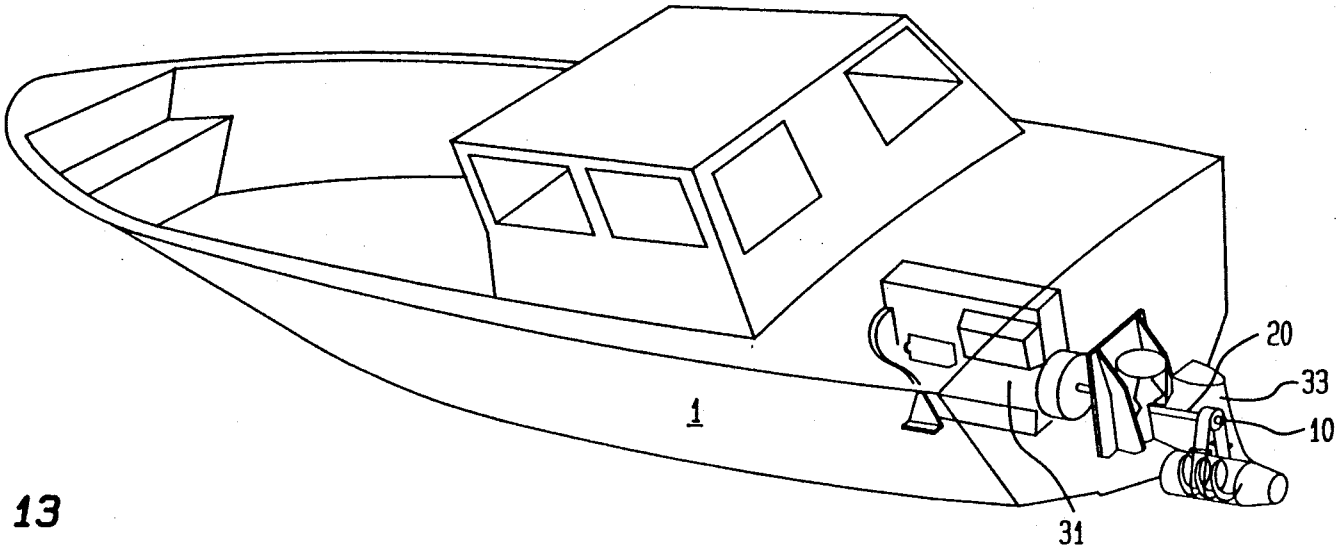
FIG. 12 is a perspective view of a boat with a jet propulsion unit disposed astern.

The drive shaft 20 of a boat 1 is inserted into the casing 10*a* surrounding the jet propulsion device 10 with the jet propulsion pipe 11 and the drive, as illustrated in FIG. 12.

Figure 13:
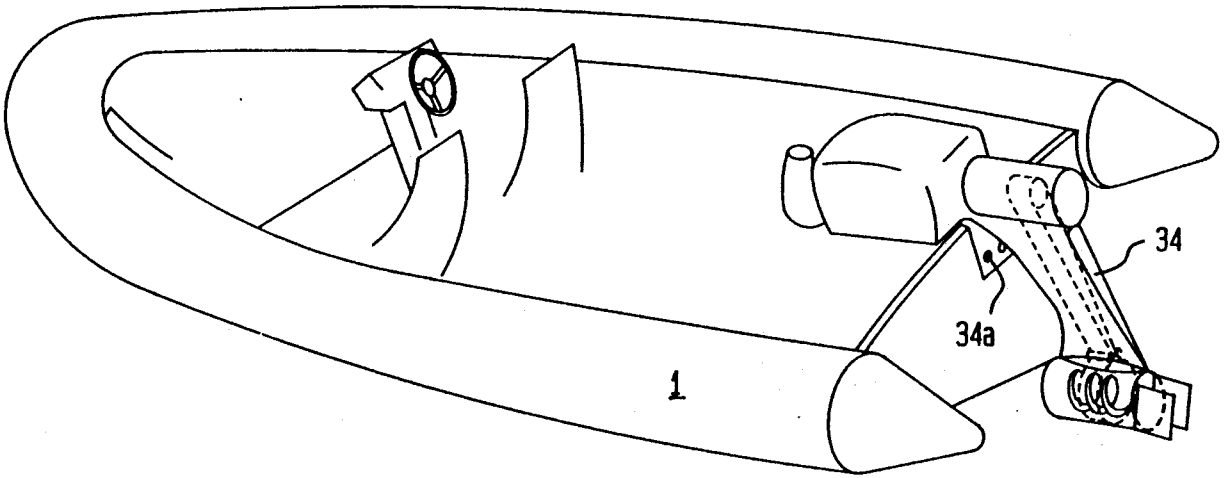
FIG. 13 is a perspective view of a boat including an outboard motor according to the invention.

Finally, an outboard motor 34 is illustrated in FIG. 13 representing the jet propulsion unit 31 and the described jet propulsion device 10 as a unit. The outboard motor 34 can be disengaged from the stern 1*b* of the boat by a flange connection 34*a*. Of course, the outboard motor 34 can also be formed pivotable around a rudder shaft.

Figure 7:
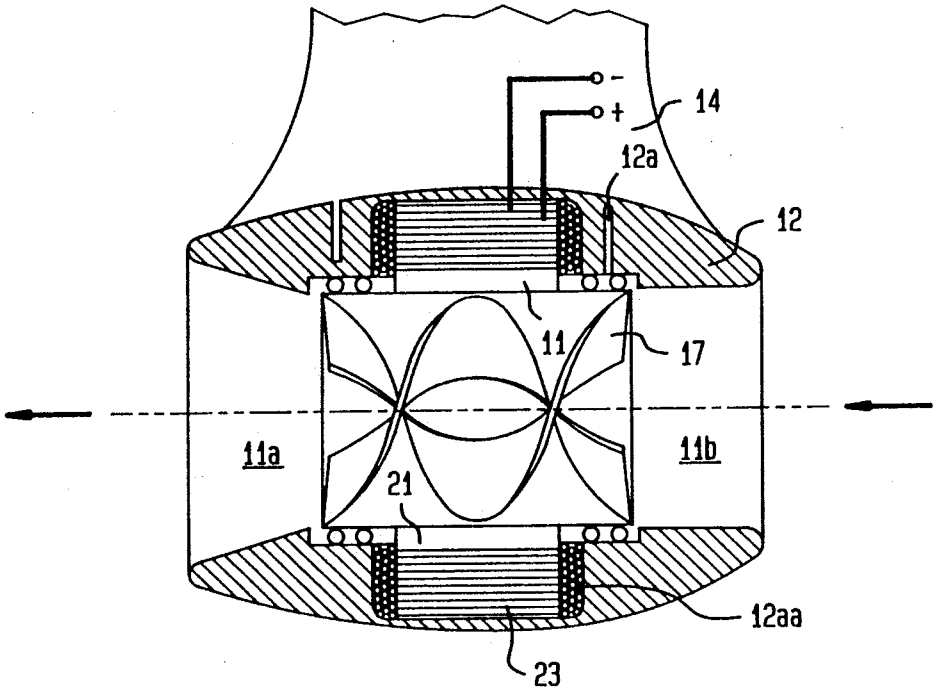
FIG. 7 is a front elevational view of a support of the jet propulsion pipe in an enveloping casing.
Figure 14:
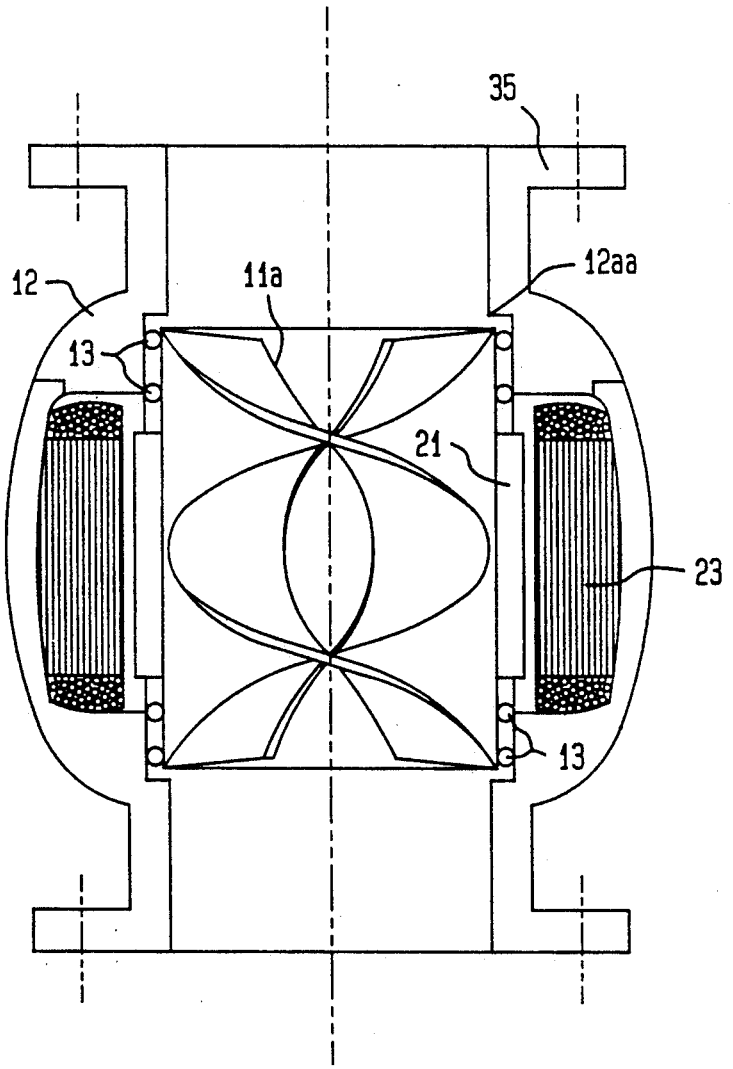
FIG. 14 is a sectional view of an invention circulating pump with connection flanges.

The jet propulsion pipe 11 in FIG. 14 is constructed according to the same principles as it is illustrated in FIG. 7, however, with the difference that, according to FIG. 14, the enveloping pipe casing 12 is formed as an armature with flange connections 35. In this structure, it can serve as a circulating pump in a liquid circulating system, such as, for example, in a hot-water system. It is recognized that, since both the lubrication as well as the cooling are not of such a problematic nature as in conventional circulating pumps, the operation is also quiet, and thus a low noise operation is assured. This is a particularly advantageous feature and distinguishes the jet propulsion device according to the invention.

It will be understood that each of the elements described above, or two or more together, may also find a useful application in other types of jet propulsion systems differing from the types described above.

While the invention has been illustrated and described as embodied in the context of a jet propulsion device for watercraft, aircraft, and circulating pumps, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A jet propulsion unit for propulsion of watercraft comprising a jet propulsion pipe having an inner jacket and an outer jacket;

an enveloping pipe casing supporting the jet propulsion pipe;

a rotor formed by at least one screw, wherein said screw exhibits an outer edge and a through borehole;

an intake port and a discharge port;

where a fluid, flowing into the jet propulsion pipe is accelerated by the screw in a direction opposite to the intended thrust direction, and wherein a solid connection of the outer edge of the screw to the inner jacket of the jet propulsion pipe results in a joint rotation of said screw with said jet propulsion pipe, and wherein said jet propulsion pipe is driven at its outer jacket, wherein an edge screw is formed by the screw with the through borehole, where part of the fluid entering into the jet propulsion pipe is not directly accelerated by said edge screw, and wherein said jet propulsion pipe protrudes on one side of said enveloping pipe casing, said jet propulsion pipe carrying one screw propeller attached to said jet propulsion pipe and rotating with said jet propulsion pipe and forming an additional drive element, said screw propeller having a diameter greater than the diameter of said jet propulsion pipe.

2. The jet propulsion unit according to claim 1, wherein the jet propulsion pipe is supported in an enveloping pipe.

3. The jet propulsion unit according to claim 1, wherein the enveloping pipe casing is attached to a stand.

4. The jet propulsion unit according to claim 1, wherein the enveloping pipe casing is attached to an extension arm casing, and wherein the enveloping pipe casing forms a single piece with the extension arm casing.

5. The jet propulsion unit according to claim 1, wherein the intake port of the jet propulsion pipe is free of thrust propulsion elements formed by the edge screw.

* * * * *